US010662515B2

(12) United States Patent
Saegusa

(10) Patent No.: US 10,662,515 B2
(45) Date of Patent: May 26, 2020

(54) COPPER ALLOY SHEET MATERIAL AND METHOD OF MANUFACTURING THE SAME

(71) Applicant: JX NIPPON MINING & METALS CORPORATION, Tokyo (JP)

(72) Inventor: Kei Saegusa, Kanagawa (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 369 days.

(21) Appl. No.: 15/471,349

(22) Filed: Mar. 28, 2017

(65) Prior Publication Data

US 2017/0283925 A1 Oct. 5, 2017

(30) Foreign Application Priority Data

Mar. 31, 2016 (JP) ..... 2016-073376

(51) Int. Cl.

| | |
|---|---|
| ***C22F 1/08*** | (2006.01) |
| ***B22D 11/00*** | (2006.01) |
| ***B22D 21/00*** | (2006.01) |
| ***C22C 9/06*** | (2006.01) |

(52) U.S. Cl.

CPC ..... *C22F 1/08* (2013.01); *B22D 11/004* (2013.01); *B22D 21/005* (2013.01); *C22C 9/06* (2013.01)

(58) Field of Classification Search

CPC .... C22F 1/08; C22C 9/00; C22C 9/06; B22D 11/004; B22D 21/005

See application file for complete search history.

(56) References Cited

U.S. PATENT DOCUMENTS

| | | | | |
|---|---|---|---|---|
| 9,412,482 | B2 | 8/2016 | Kamada et al. | |
| 2010/0269959 | A1* | 10/2010 | Gao | C22C 9/00 148/554 |
| 2017/0283924 | A1* | 10/2017 | Saegusa | C22C 9/00 |

FOREIGN PATENT DOCUMENTS

| | | | |
|---|---|---|---|
| CN | 103789571 | A | 5/2014 |
| JP | 2008024999 | A | 2/2008 |
| JP | 2010275622 | A | 12/2010 |
| JP | 2011162848 | A | 8/2011 |

* cited by examiner

*Primary Examiner* — John A Hevey

(74) *Attorney, Agent, or Firm* — Faegre Drinker Biddle & Reath LLP

(57) ABSTRACT

A copper alloy sheet material includes 0.5 to 2.5 mass % of Ni, 0.5 to 2.5 mass % of Co, 0.30 to 1.2 mass % of Si and 0.0 to 0.5 mass % of Cr and the balance Cu and unavoidable impurities, wherein an X-ray diffraction intensity ratio is $1.0 \leq I\{200\}/I_0\{200\} \leq 5.0$ when I{200} is a result of the X-ray diffraction intensity of {200} crystal plane of sheet surface and $I_0\{200\}$ is a result of the X-ray diffraction intensity of {200} crystal plane of a standard powder of pure copper, and wherein 0.2% yield strength in a rolling parallel direction (RD) is 800 MPa or more and 950 MPa or less, an electrical conductivity of 43.5% IACS or more and 53.0% IACS or less, 180 degree bending workability in a rolling parallel direction (GW) and a rolling perpendicular direction (BW) is R/t=0, and a difference between the rolling parallel direction (RD) and a rolling perpendicular direction (TD) of the 0.2% yield strength is 40 MPa or less.

4 Claims, 2 Drawing Sheets

COPPER ALLOY SHEET MATERIAL AND METHOD OF MANUFACTURING THE SAME

BACKGROUND OF THE INVENTION

1. Field of the Invention

The present invention relates to an age-hardening type copper alloy sheet material and a method of manufacturing the same. More particularly, it relates to a Cu—Ni—Si based alloy sheet material that is suitable for use in various electronic components such as connectors, lead frames, pins, relays, switches, etc., and a method of manufacturing the same.

2. Description of Related Art

Along with a market demand for consumer electronics such as smartphones, miniaturization and thinning of copper alloy sheet materials for electronic materials used for various electronic components such as connectors, lead frames, pins, relays, switches and the like, included in electronic devices have been rapidly progressing in recent years. For this reason, the material properties required for the copper alloy sheet material for electronic materials are becoming more severe. It is required to achieve both high strength to withstand a stress applied at the time of assembling and operating the electric components, high conductivity with little occurrence of Joule heat at the time of supplying electricity, and good bending workability without occurrence of cracks at the time of processing. Specifically, there is a large market demand for copper alloy sheet materials for electronic materials having compatibility of 0.2% yield strength (rolling parallel direction (RD)) of 800 MPa or more, electrical conductivity of 43.5% IACS or more, and 180 degree bending workability in rolling parallel direction (GW) and rolling perpendicular direction (BW) of R/t=0.

In addition to these characteristics, in recent years, there is a demand for material properties in which a difference between the rolling parallel direction (RD) and the rolling perpendicular direction (TD) of the 0.2% yield strength (so-called strength anisotropy) is minimized (40 MPa or less). This is because press working is often performed by press manufacturers who are direct customers of copper alloy manufacturers for electronic materials so that longitudinal directions of pins or connectors becomes perpendicular to rolling direction of copper alloy material in order to improve the yield and because a strength in a direction perpendicular to the rolling direction affects contact pressure and fatigue characteristics of the electric components.

However, it is acknowledged that there is generally a trade-off relationship between strength, conductivity, and bending strength anisotropy. For example, since there is a trade-off relationship between strength and conductivity, it is impossible to meet these requirements simultaneously with the solid solution curing type copper alloy sheet material typified by phosphor bronze, brass, nickel silver and the like. In recent years, precipitation type copper alloy sheet materials such as Cu—Ni—Si type alloys (so-called Corson alloy) capable of simultaneously satisfying this demand level are frequently used. In this copper alloy, fine precipitates are uniformly dispersed by subjecting a solution treatment of a supersaturated solid solution to aging treatment, thereby simultaneously improving the strength and conductivity of the alloy.

Even in Cu—Ni—Si based alloys that can achieve high strength and high conductivity, it is not easy to improve the bending property and the strength anisotropy while maintaining these properties. In general, the copper alloy sheet material has a trade-off relationship between the above-mentioned strength and conductivity, and also has a trade-off relationship between the strength and the bending workability. Therefore, when adopting a method of increasing the degree of rolling after the aging treatment or a method of increasing the added amount of the solute elements of Ni and Si, the bending workability tends to be greatly reduced. There is also a trade-off relationship between the strength and the strength anisotropy, and there is a tendency that the strength anisotropy tends to be greater if a method of increasing the degree of finish rolling in order to increase the strength is applied. Therefore, it is extremely difficult to combine these four kinds of properties, which is a big problem for copper alloy materials.

In recent years, a method for controlling crystal orientation, precipitates, dislocation density and the like has been proposed as a method for combining these various material properties in the Cu—Ni—Si based alloy. For example, Patent Document 1 proposes a method that achieves both high strength, high conductivity, and good bending workability, by appropriately controlling an intermediate annealing condition and a solution treatment condition and increasing a ratio of the {200} crystal plane (so-called Cube orientation) and a density of annealing twin crystals. In addition, Patent Document 2 proposes a method for achieving both good bending workability and small strength anisotropy by appropriately controlling the solution treatment condition and the aging treatment condition, suppressing the finish rolling working degree low, and optimizing precipitate density and crystal grain size. Further, Patent Document 3 proposes a method for achieving both high strength, high conductivity, good bendability, and good strength anisotropy by controlling degree of rolling and heating rate of solution treatment condition to control {200} crystal plane and dislocation density so that the {200} crystal plane is remained even if the degree of finish rolling process is increased.

CITATION LIST

Patent Documents

Patent Document 1: Japanese Unexamined Patent Publication No. 2010-275622

Patent Document 2: Japanese Unexamined Patent Application Publication No. 2008-24999

Patent Document 3: Japanese Unexamined Patent Application Publication No. 2011-162848

SUMMARY OF INVENTION

However, it is difficult to manufacture a material having low strength anisotropy since the manufacturing method of Patent document 1 does not consider the strength anisotropy.

Further, according to the method of Patent Document 2, it is difficult to satisfy the market demand of 0.2% yield strength (rolling parallel direction) of 800 MPa or more since the strength level is low because the working degree of the finish rolling is suppressed to 30% or less to decrease the strength anisotropy. Also in the method of Patent Document 3, the market demand cannot be satisfied because the material has the 0.2% yield strength (rolling parallel direction) of 800 MPa or less and the electrical conductivity of less than 43.5% IACS.

The present invention has been made in view of such a situation as described above and it is an object of the present invention to provide a copper alloy sheet material capable of reducing strength anisotropy while maintaining strength, electrical conductivity and bending workability at high level.

As a result of conducting detailed studies to solve the above problems, the inventors have found that it can be achieved by a Cu—Ni—Si alloy containing Co and Cr. The inventors have conducted extensive studies on the Cu—Ni—Si based alloy containing Co and Cr and found that the strength in the direction perpendicular to the rolling direction is rapidly increased and the strength anisotropy can be reduced while maintaining strength, electrical conductivity and bending workability at high level by performing finish cold rolling step and subsequent low temperature annealing step under appropriate conditions, and completed the present invention.

The present invention has been made based on the above findings. An aspect of the present invention includes a copper alloy sheet material encompassing 0.5 to 2.5 mass % of Ni, 0.5 to 2.5 mass % of Co, 0.30 to 1.2 mass % of Si and 0.0 to 0.5 mass % of Cr, and the balance Cu and unavoidable impurities, wherein an X-ray diffraction intensity ratio is $1.0 \leq I\{200\}/I_0\{200\} \leq 5.0$ when $I\{200\}$ is a result of the X-ray diffraction intensity of {200} crystal plane of sheet surface and $I_0\{200\}$ is a result of the X-ray diffraction intensity of {200} crystal plane of a standard powder of pure copper, and wherein 0.2% yield strength in a rolling parallel direction (RD) is 800 MPa or more and 950 MPa or less, an electrical conductivity of 43.5% IACS or more and 53.0% IACS or less, 180 degree bending workability in a rolling parallel direction (GW) and a rolling perpendicular direction (BW) is R/t=0, and a difference between the rolling parallel direction (RD) and a rolling perpendicular direction (TD) of the 0.2% yield strength is 40 MPa or less.

An embodiment of the copper alloy sheet material of the present invention encompasses one or more elements selected from the group consisting of Mg, Sn, Ti, Fe Zn and Ag by 0.5 mass % or less in total.

Another aspect of the present invention inheres in a method of manufacturing a copper alloy sheet material encompassing: melting and casting step of melting and casting a raw material of copper alloy having a composition of 0.5 to 2.5 mass % of Ni, 0.5 to 2.5 mass % of Co, 0.30 to 1.2 mass % of Si and 0.0 to 0.5 mass % of Cr, and the balance Cu and unavoidable impurities; hot rolling step of performing hot rolling while lowering the temperature from 950° C. to 400° C. after the melting and casting step; cold rolling step of performing cold rolling at a working degree of 30% or more after the hot rolling step; solution treatment step of performing a solution treatment at a heating temperature of 700° C. to 980° C. for 10 seconds to 10 minutes after the cold rolling step; aging treatment step of performing aging treatment at 400° C. to 600° C. for 5 to 20 hours after the solution treatment step; finish cold rolling step of performing cold rolling at a working degree of 30% to 50% after the aging treatment step so as to obtain a copper alloy sheet material having an electrical conductivity of 43.5% IACS or more and 49.5% IACS or less and satisfying an X-ray diffraction intensity ratio of {200} crystal plane of $1.0 \leq I\{200\}/I_0\{200\} \leq 5.0$ by the finish cold rolling step; and subjecting the copper alloy sheet to a low temperature annealing step at a temperature of 250° C. to 600° C. for 10 to 1000 seconds, wherein a manufacturing condition is set such that a calculation formula of $K=(a/30)\times\{3.333\times EC^2-291.67EC+6631\}$ is satisfied between the working degree a (%) of the finish cold rolling step, the electrical conductivity EC (% IACS) of the finish cold rolling step and the temperature K (° C.) of the low temperature annealing step.

An embodiment of the method of manufacturing a copper alloy sheet material includes adding up to 0.5 mass % in total of one or more elements selected from the group consisting of Mg, Sn, Ti, Fe Zn and Ag to the copper alloy sheet material.

According to the present invention, there are provided a copper alloy sheet material and method thereof capable of reducing strength anisotropy while maintaining strength, electrical conductivity and bending workability at high level.

DESCRIPTION OF EMBODIMENTS

Figure 1:
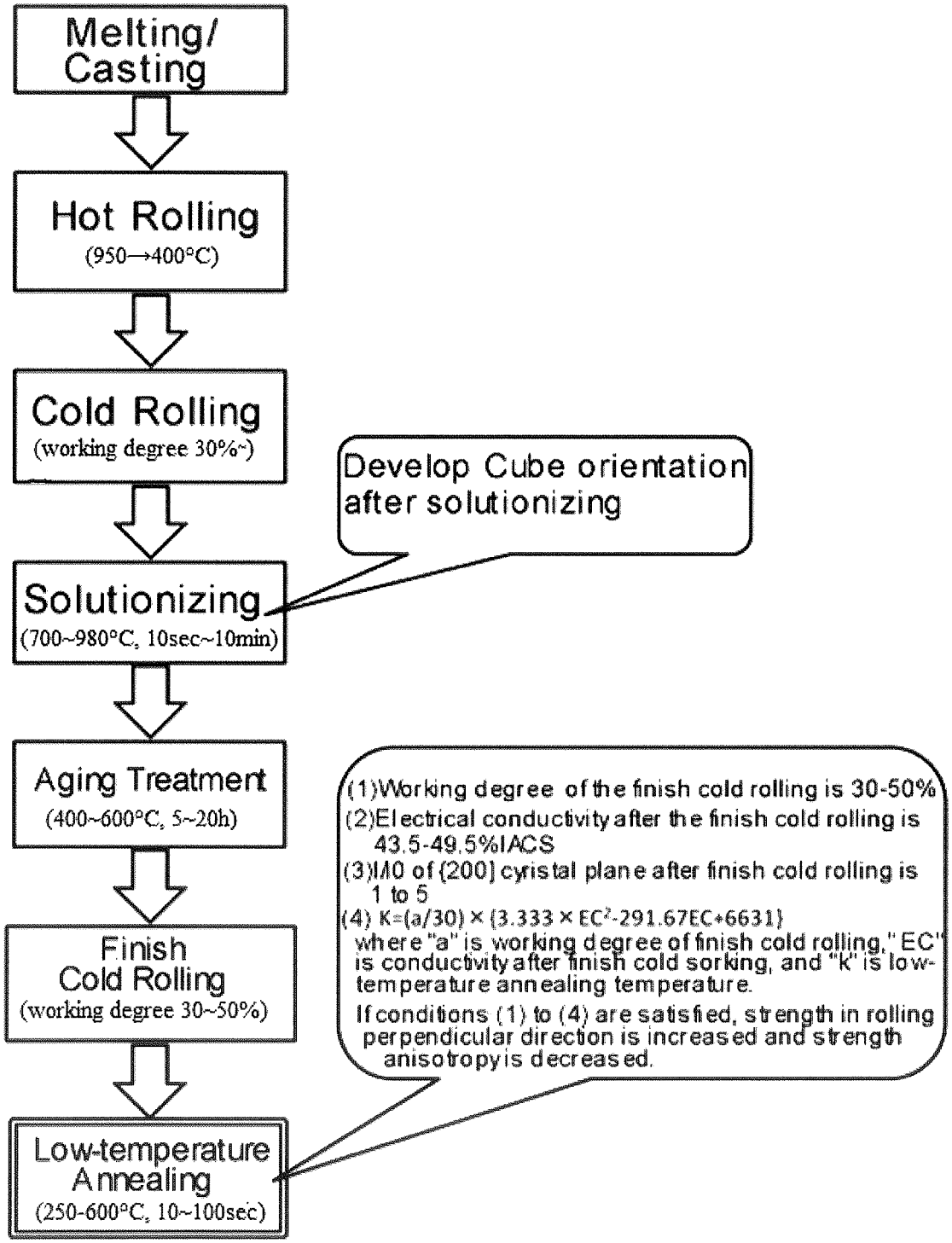
FIG. 1 is a flowchart of a manufacturing method of a copper alloy sheet material according to an embodiment of the present invention.

Hereinafter, a copper alloy sheet material according to an embodiment of the present invention will be described. The copper alloy sheet material according to the embodiment of the present invention includes 0.5 to 2.5 mass % of Ni, 0.5 to 2.5 mass % of Co, 0.30 to 1.2 mass % of Si and 0.0 to 0.5 mass % of Cr, and the balance Cu and unavoidable impurities. The copper alloy sheet material has an X-ray diffraction intensity ratio of $1.0 \leq I\{200\}/I_0\{200\} \leq 5.0$ when $I\{200\}$ is a result of the X-ray diffraction intensity of {200} crystal plane of sheet surface and $I_0\{200\}$ is a result of the X-ray diffraction intensity of {200} crystal plane of a standard powder of pure copper. Alternatively, the copper alloy sheet material may have an area ratio in Cube orientation as a result of SEM-EBSP method of 4.0% to 20.0%. The copper alloy sheet material has 0.2% yield strength in a rolling parallel direction of 800 MPa or more and 950 MPa or less, an electrical conductivity of 43.5% IACS or more and 53.0% IACS or less, 180 degree bending workability in a rolling parallel direction (GW) and a rolling perpendicular direction (BW) of R/t=0, and also has a difference between the rolling parallel direction (RD) and a rolling perpendicular direction (TD) of the 0.2% yield strength of 40 MPa or less. Hereinafter, this copper alloy sheet material and a method for producing the same will be described in detail.

(Alloy Composition)

An embodiment of the copper alloy sheet material according to the present invention includes Cu—Ni—Co—Si based alloy containing Cu, Ni, Co and Si, and contains unavoidable impurities for casting. Ni, Co and Si form Ni—Co—Si based intermetallic compound by applying appropriate heat treatment, so that it is possible to achieve high strength without deteriorating electrical conductivity.

For Ni and Co, it is necessary to include Ni: about 0.5 to about 2.5 mass %, Co: about 0.5 to about 2.5 mass % to satisfy target strength and electrical conductivity. Preferably, Ni may be from about 1.0 to about 2.0 mass % and Co may be from about 1.0 to about 2.0 mass %, and more preferably, Ni may be from about 1.2 to about 1.8 mass %, Co may be from about 1.2 to about 1.8 mass %. However, desired strength cannot be obtained if the addition amounts of Ni and Co are Ni: less than about 0.5 mass % and Co: less than about 0.5 mass %, respectively. On the other hand, with Ni: more than about 2.5% by mass, Co: more than about 2.5% by mass, high strengthening can be attempted but electrical conductivity is significantly reduced, and further, hot working capability is deteriorated. For Si, it is necessary to include Si about 0.30 to about 1.2 mass % to satisfy target strength and electrical conductivity. Preferably, Si may be from about 0.5 to about 0.8 mass %. However, desired strength cannot be obtained if the addition amount of Si is less than about 0.3 mass %. High strengthening can be attempted but electrical conductivity is significantly reduced, and further, hot working capability is deteriorated if the addition amount of Si is more than about 1.2 mass %.

([Ni+Co]/Si Mass Ratio)

Ni—Co—Si based precipitates formed by Ni, Co and Si are thought to be intermetallic compounds mainly composed of (Co+Ni) Si. However, Ni, Co and Si in the alloy are not always all precipitated by aging treatment, but exist in a state of solid solution in the Cu matrix to a certain extent. Ni and Si in the solid solution state slightly improve the strength of the copper alloy sheet material, but its effect is small as compared with the precipitation state, and it becomes a factor of lowering the electrical conductivity. Therefore, it is preferable that a ratio of contents of Ni, Co and Si be as close as possible to a composition ratio of the precipitate (Ni+Co) Si. Accordingly, it is preferable to adjust [Ni+Co]/Si mass ratio to 3.5 to 6.0, more preferably to 4.2 to 4.7.

(Addition Amount of Cr)

In the present invention, it is preferable to add Cr to the above-mentioned Cu—Ni—Si alloy containing Co at a maximum of about 0.5% by mass, preferably about 0.09 to about 0.5% by mass, more preferably about 0.1 to about 0.3% by mass. By subjecting Cr to an appropriate heat treatment, Cr precipitates as Cr alone or a compound with Si in the copper mother phase, and the conductivity can be increased without impairing the strength. However, when Cr concentration is more than about 0.5% by mass, coarse inclusions which do not contribute to strengthening are formed, and workability and plating properties are impaired, such being undesirable.

(Other Additive Elements)

Addition of predetermined amounts of Mg, Sn, Ti, Fe, Zn and Ag also has an effect of improving manufacturability such as improvement of plating properties and hot workability due to refinement of ingot structure. Therefore, one or two or more of these additive elements can be appropriately added to the Cu—Ni—Si based alloy containing Co according to the required characteristics. In such a case, the total amount thereof may be at most about 0.5% by mass, preferably about 0.01 to 0.1% by mass. If the total amount of these elements exceeds about 0.5% by mass, the conductivity decreases and the manufacturability deteriorates remarkably, which is not preferable.

It is understood by those skilled in the art that the individual addition amounts are changed depending on the combination of the additive elements to be added. In one embodiment, for example, Mg may be added 0.5% by mass or less, Sn may be added 0.5% by mass or less, Ti may be added 0.5% by mass or less, Fe may be added 0.5% by mass or less, Zn may be added 0.5% by mass or less, and Ag may be added 0.5% by mass or less. The copper alloy sheet material according to the present invention is not necessarily limited to these upper limit values as long as the finally obtained copper alloy sheet has a combination and addition amount of additive elements in order to show a 0.2% yield strength of 800 MPa or more and 950 MPa or less and an electrical conductivity of 43.5% IACS or more and 53.0% IACS or less.

The copper alloy sheet material according to the present invention can be achieved by the method shown in a flowchart of FIG. 1. More specifically, the step includes a melting and casting step of melting and casting a raw material of copper alloy; a hot rolling step of performing hot rolling while lowering the temperature from 950° C. to 400° C. after the melting and casting step; a cold rolling step of performing cold rolling at a working degree of 30% or more after the hot rolling step; a solution treatment step of performing a solution treatment at a heating temperature of 700° C. to 980° C. for 10 seconds to 10 minutes after the cold rolling step; an aging treatment step of performing aging treatment at 400° C. to 600° C. for 5 to 20 hours after the solution treatment step; a finish cold rolling step of performing cold rolling at a working degree of 30% to 50% after the aging treatment step; and subjecting the copper alloy sheet to a low temperature annealing step at a temperature of 250° C. to 600° C. for 10 to 1000 seconds. Further, the after hot rolling, surface cutting may be performed as necessary. After the heat treatment, pickling, polishing, and degreasing may be conducted as necessary. Hereinafter, these steps will be described in detail.

(Melting and Casting Step)

A slab is produced by melting a raw material of the copper alloy and then casting it by continuous casting or semi-continuous casting according to the same manner as the general melting and casting method of the copper alloy sheet material. For example, raw materials such as electrolytic copper, Ni, Si, Co and Cr may be first melted using an atmospheric melting furnace to obtain a molten metal having the desired composition, and the molten metal may be then casted into an ingot. In one embodiment of the production method according to the present invention, one or more selected from the group consisting of Mg, Sn, Ti, Fe, Zn and Ag can be contained in the total amount of up to about 0.5% by mass.

(Hot Rolling Step)

The hot rolling is carried out in the same manner as the general copper alloy producing method. The hot rolling of the slab is performed in several passes while lowering the temperature from 950° C. to 400° C. It should be noted that the hot rolling is performed in one or more passes at a temperature lower than 600° C. The total working degree may be preferably approximately 80% or more. After the hot rolling, it is preferable to perform rapid cooling by water cooling or the like. After the hot processing, surface cutting or pickling may be conducted as necessary.

(Cold Rolling Step)

For the copper alloy sheet obtained in the previous step, cold rolling called "mid-roll" is performed. The cold rolling will be the same as the rolling method of a general copper alloy, and it is sufficient if the working degree is 30% or more. The working degree may be appropriately adjusted according to the desired thickness of the product and the degree of finish of the finish cold rolling.

(Preliminary Annealing Step (Optional))

In the present invention, if the {200} crystal plane does not satisfy $1.0 \leq I\{200\}/I_0\{200\} \leq 5.0$ after the finish cold rolling in the subsequent process, an increase in strength in the direction perpendicular to the rolling direction due to low-temperature annealing hardening in the preliminary annealing step in the final process does not occur and the problem of the present invention cannot be achieved. Therefore, immediately after the cold rolling step, a preliminary annealing may be performed to develop the {200} crystal plane as described in the method of Patent Document 1. The method of developing the {200} crystal plane in the present step is not limited only to the method as described in Patent Document 1, but may be a method based on the control of the heating rate of the solution treatment of the method as disclosed in Patent Document 3. Accordingly, the preliminary annealing step can be arbitrarily carried out in the present invention.

(Solutionizing Treatment Step)

In the solutionizing treatment, heating is carried out at an elevated temperature of about 700 to about 980° C. for 10 seconds to 10 minutes to allow solid solution of a Co—Ni—Si based compound in the Cu matrix while at the same time recrystallizing the Cu matrix. In this step, the recrystallization of the rolled structure generated by the cold rolling in the previous step and formation of the {200} crystal plane are performed. As described above, the method of developing the {200} crystal plane may be the method of Patent Document 1 or the method of Patent Document 3. In the present invention, any method can be used if the {200} crystal plane can be left in the range of $1.0 \leq I\{200\}/I_0\{200\} \leq 5.0$ after the finish cold rolling step.

In the present invention, the conditioning of the solution treatment for achieving 0.2% yield strength (in the rolling parallel direction) of electrical conductivity of 43.5% IACS or more may be the same as a general method and those skilled in the art can easily achieve it. More particularly, the strength and the conductivity can be effectively increased by carrying out the cooling from about 400° C. to room temperature at a cooling rate of about 10° C. or higher per a second, and preferably about 15° C. or higher per a second, and more preferably about 20° C. or higher per a second or more. However, if the cooling rate is too high, any sufficient effect of increasing the strength may not be obtained. Therefore, the cooling rate may be preferably about 30° C. or lower per a second, and more preferably about 25° C. or lower per a second. The cooling rate can be adjusted by any method known to one of ordinary skill in the art. Generally, a decreased amount of water per unit time may cause a decreased cooling rate. Therefore, for example, the increase in the cooling rate can be achieved by increasing the number of the water cooling nozzle or increasing the amount of water per unit time. The "cooling rate" as used herein refers to a value (° C./s) calculated from the equation: "(solutionizing temperature—400) (° C.)/cooling time (s)", based on the measured cooling time from the solutionizing temperature (700° C. to 980° C.) to 400° C.

(Aging Treatment Step)

In the aging treatment step, it is necessary to adjust the conditions so that the electrical conductivity after the finish cold rolling step of the next step becomes 43.5 to 49.5% IACS. If it falls outside the range of 43.5 to 49.5% IACS, the strength in the direction perpendicular to the rolling direction does not increase in the low temperature annealing step of the final process, and the problem of the present invention cannot be achieved. Also, in finish cold rolling immediately after the aging treatment process, the electrical conductivity decreases by 0.0 to 1.0% IACS due to general reasons such as introduction of dislocation and the like. Therefore, the target electrical conductivity of this aging treatment step will be about 44.5 to 50.5% IACS. The method of adjusting the aging treatment conditions may be the same manner as the general copper alloy manufacturing method and it can be easily achieved by those skilled in the art. For example, the aging treatment may be carried out by heating the Ni—Co—Si compound solutionized in the solutionalizing step in a temperature range of from about 400 to about 600° C. for about 5 to 20 hours to deposit the Ni—Co—Si compound as a fine particle. The electrical conductivity of about 44.5 to 50.5% IACS can be achieved by this condition.

(Finish Cold Rolling Step)

Normally, when the finish cold rolling is carried out at a high working degree in order to increase the strength of the alloy after the aging treatment, the strength anisotropy often deteriorates. However, in the present invention, by designing the working degree in the finish cold rolling stop to be 30% or more and conducting the low temperature annealing step in the final process under appropriate temperature conditions, the strength in the direction perpendicular to the rolling direction is abruptly increased and the strength anisotropy can be improved. However, when the working degree is set to 50% or more, the strength of the alloy becomes too high and the bending workability deteriorates. Therefore, the finish cold rolling step may be preferably conducted at working degree in the range of 30 to 50%.

In this finish cold rolling, the rolling texture in which the {220} crystal plane is the main orientation component generally develops and the {200} crystal plane decreases. Therefore, in the present invention, it is necessary to adjust the working degree such that the {200} crystal plane satisfies $1.0 \leq I\{200\}/I_0\{200\} \leq 5.0$ after finish cold rolling. (Alternatively, the working degree may be adjusted so that the area ratio of the Cube orientation after the finish cold rolling becomes 4 to 20% according to the SEM-EBSP method.)

Therefore, even if the working degree is in the range of 30 to 50%, when the {200} crystal plane after finish cold rolling is less than 1.0 or exceeds 5.0, sufficient low temperature annealing hardening does not occur. An attention is necessary. The working degree of the finish cold rolling may be determined within a range of 30 to 50% in accordance with the amount of the {200} crystal plane after the solutionizing treatment. Although the {200} crystal plane is one of the conditions under which the low temperature annealing hardening occurs, it also has the effect of improving the bending workability of the final product.

(Low Temperature Annealing Step)

Figure 2:
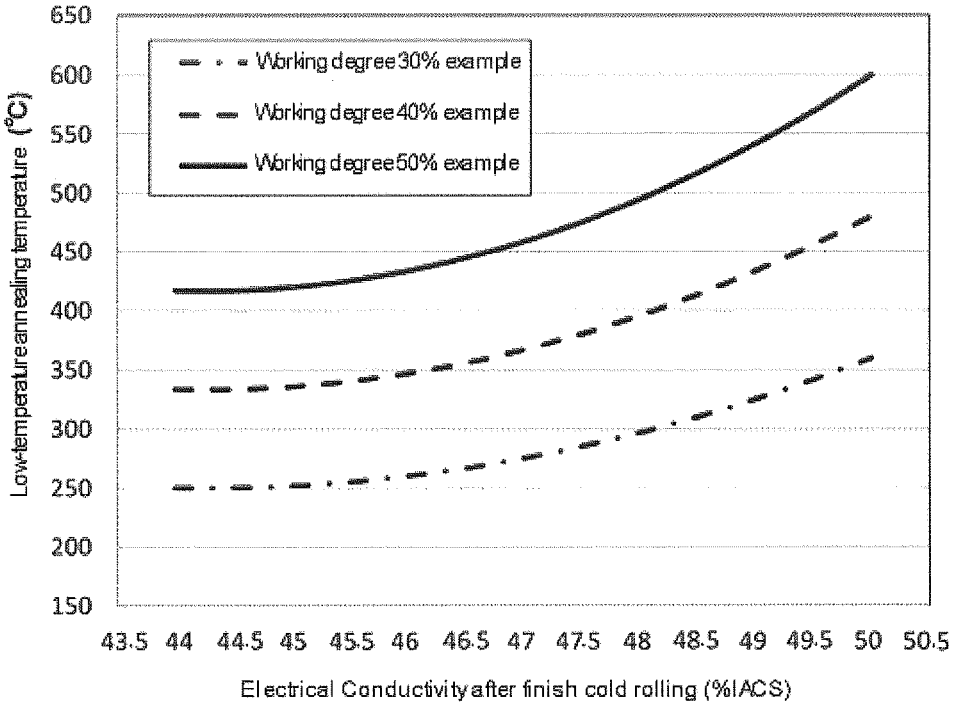
FIG. 2 is a graph showing a relationship between a low temperature annealing temperature and an electrical conductivity of a copper alloy sheet material after finish cold rolling according to an embodiment of the present invention.

Usually, after the finish cold rolling step, low-temperature annealing is often carried out optionally for the purpose of reducing the residual stress of the copper alloy sheet material, improving the spring limit value and the stress relaxation resistance characteristic. However, in the present embodiment, only when the manufacturing condition is set such that the working degree of the finish cold rolling is within a range of 30 to 50%, the {200} crystal plane after the finish cold rolling satisfies $1.0 \leq I\{200\}/I_0\{200\} \leq 5.0$, the electrical conductivity after the finish cold rolling filfills 43.5 to 49.5% IACS, a calculation formula of $K=(a/30)\times\{3.333\times EC^2-291.67EC+6631\}$ . . . (Formula 1) is satisfied between the working degree a (%) of the finish cold rolling step, the electrical conductivity EC (% IACS) after finish cold rolling step and the temperature K (° C.) of the low temperature annealing step, and the low-temperature annealing is carried out for 10 to 1000 seconds, the strength in the direction perpendicular to the rolling direction is increased by about 50 MPa, and a material having low strength anisotropy can be obtained. (See FIG. 2. The low-temperature annealing may be carried out with an integral value in the range of ±0.5 of the temperature obtained by substituting the working degree and the electrical conductivity into the formula 1).

In this low-temperature annealing step, the bending workability hardly deteriorates and there is an effect of improving the electrical conductivity by about 0 to 4.0% IACS. (Consequently, the electrical conductivity of finally obtained product (copper alloy plate) becomes 43.5 to 53.0% IACS). Although the 0.2% yield strength in the rolling parallel direction slightly increases and decreases, it is in the range of ±10 MPa as compared with that after the finish cold rolling, and is approximately equal.

The conditions of the working degree of the finish rolling, the range of the {200} crystal plane, the electrical conductivity after finish rolling and the relationship between the finish rolling working degree and the electrical conductivity after the finish rolling and the temperature of low-temperature annealing (formula 1) are empirically found by the present inventors and the detailed mechanism thereof is under investigation. However, this phenomenon is presumed to originate from Cottrell sticking. The lower the electrical conductivity after the finish rolling, the larger the amount of elements such as Co, Ni, Si and the like solid-dissolved in the parent phase, and these elements are fixed to the rolling-derived dislocation. As the electrical conductivity after finish rolling is lower, the amount of elements such as Co, Ni, Si, etc. solid-dissolved in the matrix is larger, and these elements are fixed to the rolling-derived dislocation. Therefore, these calculation formulas are considered to be established.

In the low-temperature annealing, since the heating temperature is overwhelmingly dominant over the heating time, the heating time may be within the range of 10 to 1000 sec.

In addition, one of ordinary skill in the art would understand that any step such as grinding for removing oxide scales on the surface, polishing and shot-blast pickling may be carried out in the intervals of the respective steps, as needed.

EXAMPLES

Hereinafter, although Examples of the copper alloy sheet material and the method for manufacturing the same according to the present invention will be described in detail, these Examples are intended to provide better understanding of the present invention and its advantages, and in no way intended to limit the present invention.

As shown in Table 1, the copper alloy used in the examples of the present invention has a composition in which Mg, Sn, Ti, Fe, and Ag are added as appropriate to a copper alloy in which some contents of Ni, Co, Cr and Si are changed. The copper alloys used in the comparative examples are each Cu—Ni—Si based alloys having parameters outside the scope of the present invention.

The copper alloys having various component compositions as shown in Tables 1 and 2 were melted at 1100° C. or higher using a high frequency melting furnace and cast into ingots each having a thickness of 25 mm. Each ingot was then heated at 950 to 400° C., and hot-rolled to a thickness of 10 mm, and immediately cooled. The surface cutting was performed for each ingot to a thickness of 9 mm in order to remove scales on the surface, and the ingot was then cold-rolled to a plate thickness of 1.8 mm. The cold rolling was conducted at working degree of 60% and solutionizing treatment was conducted at 700 to 980° C. for 10 seconds to 10 minutes with a temperature raising rate of 0.1° C./s. Thereafter, the obtained alloy was immediately cooled to 100° C. or lower at the cooling rate of about 10° C./s to develop the {200} crystal plane. The obtained alloy was then subjected to the aging treatment in an inert atmosphere at 400 to 600° C. for 5 to 20 hours and finish cold rolling at the working degree of 30 to 50% so as to manufacture the copper alloy sheet material whose X-ray diffraction intensity ratio of the {200} crystal plane after finish cold rolling is $1.0 \leq I\{200\}/I_0\{200\} \leq 5.0$ and having the electrical conductivity of 43.5% IACS or more and 49.5% IACS or less after finish cold rolling. Thereafter, the low-temperature annealing process was conducted at a temperature satisfying the formula (1).

For each sheet material thus obtained, characterizations of the strength and the conductivity were carried out. For the strength, the tensile strength (TS) and the 0.2% yield strength (YS) in a direction parallel to the rolling direction and in a direction perpendicular to the rolling direction were measured by using a tensile tester according to the standard JIS Z 2241. For the conductivity, each specimen was taken such that the longitudinal direction of the specimen was parallel to the rolling direction, and the conductivity of the specimen was determined by volume resistivity measurement using a double bridge method according to the standard JIS H 0505. For the bending formability, the 180° bending in directions parallel to the rolling direction (GW) and perpendicular to the rolling direction (BW) was evaluated according to the standard JIS Z 2248. The sheet material with R/t=0 was evaluated as good (o), and the sheet material with R/t>0 was evaluated as poor (x).

For the integrated intensity ratio, the integrated intensity: I {200} at the {200} diffraction peak was evaluated by X-ray diffraction in the thickness direction of the copper alloy sheet surface, and the integrated intensity: $I_0\{200\}$ at the {200} diffraction peak was further evaluated by X-ray diffraction of the fine powder copper, using RINT 2500 available from Rigaku Corporation. Subsequently, the ratio of these: $I\{200\}/I_0\{200\}$ was calculated. For the grain size, an average grain size was determined as GS (μm) by a cutting method of the standard JIS H 0501 in a direction parallel to the rolling direction of the specimen. For the Cube orientation, area ratio was calculated by using EBSP (OIM analysis manufactured by TSL Solutions Co., LTD.).

The plating adhesion for each copper alloy sheet material was evaluated by carrying out the following method defined in the standard JIS H 8504. The specimen having a width of 10 mm was bended at 90° and then returned to the original angle (bending radius of 0.4 mm, in the direction parallel to the rolling direction (GW)), and the bended portion was then observed using an optical microscope (magnification 10×) to determine the presence or absence of peeling of the plated layer. The case where no peeling of the plated layer was observed was evaluated as good (o), and the case where the peeling of the plated layer was observed was evaluated as poor (x). The respective characterization results are shown in Table 5 through Table 8.

TABLE 1

| | Alloy Composition | | | | |
|---|---|---|---|---|---|
| | Ni | Co | Si | Cr | Other Elements |
| Example 1 | 1.30 | 1.30 | 0.60 | 0.20 | — |
| Example 2 | 1.30 | 1.30 | 0.60 | 0.20 | — |
| Example 3 | 1.30 | 1.30 | 0.60 | 0.20 | — |
| Example 4 | 1.30 | 1.30 | 0.60 | 0.20 | — |
| Example 5 | 1.30 | 1.30 | 0.60 | 0.20 | — |
| Example 6 | 1.30 | 1.30 | 0.60 | 0.20 | — |
| Example 7 | 1.30 | 1.30 | 0.60 | 0.20 | — |
| Example 8 | 1.30 | 1.30 | 0.60 | 0.20 | — |
| Example 9 | 1.30 | 1.30 | 0.60 | 0.20 | — |
| Example 10 | 1.30 | 1.30 | 0.60 | 0.20 | — |
| Example 11 | 1.30 | 1.30 | 0.60 | 0.20 | — |
| Example 12 | 1.30 | 1.30 | 0.60 | 0.20 | — |
| Example 13 | 1.30 | 1.30 | 0.60 | 0.20 | — |

TABLE 1-continued

| | Alloy Composition | | | | |
|---|---|---|---|---|---|
| | Ni | Co | Si | Cr | Other Elements |
| Example 14 | 0.52 | 1.30 | 0.60 | 0.20 | — |
| Example 15 | 2.48 | 1.30 | 0.60 | 0.20 | — |
| Example 16 | 1.30 | 0.52 | 0.60 | 0.20 | — |
| Example 17 | 1.30 | 2.47 | 0.60 | 0.20 | — |
| Example 18 | 1.30 | 1.30 | 0.31 | 0.20 | — |
| Example 19 | 1.30 | 1.30 | 1.18 | 0.20 | — |
| Example 20 | 1.30 | 1.30 | 0.60 | 0.00 | — |
| Example 21 | 1.30 | 1.30 | 0.60 | 0.11 | — |
| Example 22 | 1.30 | 1.30 | 0.60 | 0.48 | — |
| Example 23 | 1.30 | 1.30 | 0.60 | 0.20 | 0.45Mg |
| Example 24 | 1.30 | 1.30 | 0.60 | 0.20 | 0.46Sn |
| Example 25 | 1.30 | 1.30 | 0.60 | 0.20 | 0.47Ti |
| Example 26 | 1.30 | 1.30 | 0.60 | 0.20 | 0.49Fe |
| Example 27 | 1.30 | 1.30 | 0.60 | 0.20 | 0.48Zn |
| Example 28 | 1.30 | 1.30 | 0.60 | 0.20 | 0.45Ag |

TABLE 2

| | Alloy Composition | | | | |
|---|---|---|---|---|---|
| | Ni | Co | Si | Cr | Other Elements |
| Comparative Example 1 | 1.30 | 1.30 | 0.60 | 0.20 | — |
| Comparative Example 2 | 1.30 | 1.30 | 0.60 | 0.20 | — |
| Comparative Example 3 | 1.30 | 1.30 | 0.60 | 0.20 | — |
| Comparative Example 4 | 1.30 | 1.30 | 0.60 | 0.20 | — |
| Comparative Example 5 | 1.30 | 1.30 | 0.60 | 0.20 | — |
| Comparative Example 6 | 1.30 | 1.30 | 0.60 | 0.20 | — |
| Comparative Example 7 | 1.30 | 1.30 | 0.60 | 0.20 | — |
| Comparative Example 8 | 1.30 | 1.30 | 0.60 | 0.20 | — |
| Comparative Example 9 | 1.30 | 1.30 | 0.60 | 0.20 | — |
| Comparative Example 10 | 1.30 | 1.30 | 0.60 | 0.20 | — |
| Comparative Example 11 | 1.30 | 1.30 | 0.60 | 0.20 | — |
| Comparative Example 12 | 0.48 | 1.30 | 0.60 | 0.20 | — |
| Comparative Example 13 | 2.53 | 1.30 | 0.60 | 0.20 | — |
| Comparative Example 14 | 1.30 | 0.49 | 0.60 | 0.20 | — |
| Comparative Example 15 | 1.30 | 2.55 | 0.60 | 0.20 | — |
| Comparative Example 16 | 1.30 | 0.60 | 0.28 | 0.20 | — |
| Comparative Example 17 | 1.30 | 0.60 | 1.24 | 0.20 | — |
| Comparative Example 18 | 1.30 | 0.60 | 0.20 | 0.51 | — |
| Comparative Example 19 | 1.30 | 1.30 | 0.60 | 0.20 | 0.51Mg |
| Comparative Example 20 | 1.30 | 1.30 | 0.60 | 0.20 | 0.52Sn |
| Comparative Example 21 | 1.30 | 1.30 | 0.60 | 0.20 | 0.53Ti |
| Comparative Example 22 | 1.30 | 1.30 | 0.60 | 0.20 | 0.51Fe |
| Comparative Example 23 | 1.30 | 1.30 | 0.60 | 0.20 | 0.51Zn |
| Comparative Example 24 | 1.30 | 1.30 | 0.60 | 0.20 | 0.52Ag |
| Comparative Example 25 | 1.30 | 1.30 | 0.60 | 0.20 | — |

TABLE 2-continued

| | Alloy Composition | | | | |
|---|---|---|---|---|---|
| | Ni | Co | Si | Cr | Other Elements |
| Comparative Example 26 | 1.89 | 0.38 | 0.43 | — | 0.33Sn, 0.4Zn, 0.12Fe |
| Comparative Example 27 | 1.5 | 1 | 0.6 | — | 0.2Sn, 0.2Zr, 1.0Zn |

TABLE 3

| | Manufacturing method | | | |
|---|---|---|---|---|
| | Solutionizing Conditions (° C., 20 s) | Aging Treatment (° C., 8 h) | Working degree of Finish Rolling (%) | Low Temperature Annealing temperature (° C., 30 sec) |
| Example 1 | 905.5 | 500 | 30.0 | 281 |
| Example 2 | 938.0 | 500 | 40.0 | 362 |
| Example 3 | 938.0 | 500 | 50.0 | 483 |
| Example 4 | 974.3 | 500 | 40.0 | 334 |
| Example 5 | 701.2 | 500 | 40.0 | 480 |
| Example 6 | 767.2 | 500 | 40.0 | 364 |
| Example 7 | 974.3 | 500 | 40.0 | 372 |
| Example 8 | 970.7 | 500 | 40.0 | 352 |
| Example 9 | 972.3 | 500 | 40.0 | 375 |
| Example 10 | 938.0 | 500 | 30.0 | 291 |
| Example 11 | 935.5 | 500 | 40.0 | 388 |
| Example 12 | 955.3 | 500 | 50.0 | 483 |
| Example 13 | 925.7 | 500 | 50.0 | 600 |
| Example 14 | 885.6 | 500 | 30.0 | 279 |
| Example 15 | 891.7 | 500 | 30.0 | 282 |
| Example 16 | 886.8 | 500 | 30.0 | 272 |
| Example 17 | 903.2 | 500 | 30.0 | 280 |
| Example 18 | 904.6 | 500 | 30.0 | 285 |
| Example 19 | 887.3 | 500 | 30.0 | 281 |
| Example 20 | 908.5 | 500 | 30.0 | 250 |
| Example 21 | 890.5 | 500 | 30.0 | 258 |
| Example 22 | 885.7 | 500 | 30.0 | 280 |
| Example 23 | 886.6 | 500 | 30.0 | 289 |
| Example 24 | 907.2 | 500 | 30.0 | 276 |
| Example 25 | 912.7 | 500 | 30.0 | 275 |
| Example 26 | 905.4 | 500 | 30.0 | 272 |
| Example 27 | 898.4 | 500 | 30.0 | 290 |
| Example 28 | 898.4 | 500 | 30.0 | 285 |

TABLE 4

| | Manufacturing method | | | |
|---|---|---|---|---|
| | Solutionizing Conditions (° C., 20 s) | Aging Treatment (° C., 8 h) | Working degree of Finish Rolling (%) | Low Temperature Annealing temperature (° C., 30 sec) |
| Comparative Example 1 | 964.7 | 500 | 29.2 | 275 |
| Comparative Example 2 | 919.5 | 500 | 51.1 | 465 |
| Comparative Example 3 | 951.8 | 500 | 40.0 | 336 |
| Comparative Example 4 | 795.3 | 500 | 40.0 | 487 |
| Comparative Example 5 | 870.9 | 500 | 40.0 | 368 |
| Comparative Example 6 | 974.1 | 500 | 40.0 | 376 |
| Comparative Example 7 | 874.0 | 500 | 30.0 | 277 |
| Comparative Example 8 | 974.1 | 500 | 40.0 | 365 |
| Comparative Example 9 | 828.2 | 500 | 50.0 | 480 |

TABLE 4-continued

| | Manufacturing method | | | |
|---|---|---|---|---|
| | Solutionizing Conditions (° C., 20 s) | Aging Treatment (° C., 8 h) | Working degree of Finish Rolling (%) | Low Temperature Annealing temperature (° C., 30 sec) |
| Comparative Example 10 | 974.1 | 500 | 30.0 | 248 |
| Comparative Example 11 | 828.2 | 500 | 50.0 | 602 |
| Comparative Example 12 | 963.4 | 500 | 30.0 | 281 |
| Comparative Example 13 | 963.3 | 500 | 30.0 | 281 |
| Comparative Example 14 | 963.6 | 500 | 30.0 | 281 |
| Comparative Example 15 | 963.3 | 500 | 30.0 | 281 |
| Comparative Example 16 | 963.3 | 500 | 30.0 | 281 |
| Comparative Example 17 | 963.9 | 500 | 30.0 | 281 |
| Comparative Example 18 | 964.3 | 500 | 30.0 | 281 |

TABLE 4-continued

| | Manufacturing method | | | |
|---|---|---|---|---|
| | Solutionizing Conditions (° C., 20 s) | Aging Treatment (° C., 8 h) | Working degree of Finish Rolling (%) | Low Temperature Annealing temperature (° C., 30 sec) |
| Comparative Example 19 | 963.3 | 500 | 30.0 | 281 |
| Comparative Example 20 | 963.3 | 500 | 30.0 | 281 |
| Comparative Example 21 | 963.4 | 500 | 30.0 | 281 |
| Comparative Example 22 | 963.3 | 500 | 30.0 | 281 |
| Comparative Example 23 | 963.7 | 500 | 30.0 | 281 |
| Comparative Example 24 | 963.7 | 500 | 30.0 | 281 |
| Comparative Example 25 | 652.2 | 404.8 | 40.0 | not Conducted |
| Comparative Example 26 | 730.0 | 450 (4 h) | 20.0 | not Conducted |
| Comparative Example 27 | 860.0 | 460 | 40.0 | not Conducted |

TABLE 5

| | Characteristics after finish rolling | | | | | | | | | | | |
|---|---|---|---|---|---|---|---|---|---|---|---|---|
| | Crystal grain size | $I[200]/I_0[200]$ | Area ratio of Cube orientation | Tensile Strength (MPa) | | | 0.2% yield strength (MPa) | | | Electrical Conductivity | 180 degree bending workability | |
| | (um) | after finishing | (%) | RD | TD | RD − TD | RD | TD | RD − TD | (% IACS) | Good Way | Bad Way |
| Example 1 | 52.0 | 2.5 | 11.4 | 843 | 772 | 71 | 822 | 747 | 75 | 46.8 | ○ | ○ |
| Example 2 | 63.0 | 3.1 | 11.5 | 870 | 810 | 60 | 850 | 775 | 75 | 46.3 | ○ | ○ |
| Example 3 | 63.0 | 2.7 | 11.1 | 910 | 840 | 70 | 885 | 805 | 80 | 47.2 | ○ | ○ |
| Example 4 | 92.2 | 3.1 | 12.6 | 843 | 763 | 79 | 808 | 738 | 70 | 43.5 | ○ | ○ |
| Example 5 | 10.0 | 3.5 | 13.5 | 852 | 782 | 70 | 817 | 753 | 64 | 49.5 | ○ | ○ |
| Example 6 | 22.5 | 1.1 | 5.2 | 848 | 765 | 83 | 817 | 741 | 75 | 46.4 | ○ | ○ |
| Example 7 | 92.7 | 2.0 | 8.1 | 843 | 766 | 77 | 813 | 743 | 70 | 46.7 | ○ | ○ |
| Example 8 | 83.0 | 4.1 | 16.8 | 845 | 744 | 101 | 805 | 725 | 80 | 45.8 | ○ | ○ |
| Example 9 | 99.0 | 4.9 | 19.9 | 835 | 759 | 76 | 802 | 728 | 74 | 46.8 | ○ | ○ |
| Example 10 | 63.0 | 3.1 | 12.7 | 852 | 786 | 66 | 813 | 753 | 60 | 47.2 | ○ | ○ |
| Example 11 | 62.0 | 2.9 | 11.9 | 823 | 758 | 66 | 802 | 730 | 72 | 47.2 | ○ | ○ |
| Example 12 | 71.1 | 3.0 | 12.2 | 832 | 747 | 85 | 801 | 722 | 79 | 47.2 | ○ | ○ |
| Example 13 | 58.4 | 2.8 | 12.1 | 836 | 771 | 65 | 800 | 740 | 59 | 49.5 | ○ | ○ |
| Example 14 | 46.6 | 2.0 | 9.0 | 839 | 769 | 70 | 821 | 741 | 80 | 46.7 | ○ | ○ |
| Example 15 | 48.2 | 1.9 | 9.3 | 841 | 766 | 76 | 815 | 743 | 72 | 46.9 | ○ | ○ |
| Example 16 | 46.9 | 1.6 | 9.8 | 843 | 769 | 74 | 816 | 746 | 70 | 46.3 | ○ | ○ |
| Example 17 | 51.4 | 2.1 | 10.4 | 838 | 773 | 65 | 821 | 743 | 78 | 46.8 | ○ | ○ |
| Example 18 | 51.7 | 2.1 | 9.4 | 838 | 769 | 69 | 824 | 741 | 82 | 47.0 | ○ | ○ |
| Example 19 | 47.0 | 1.6 | 10.8 | 844 | 772 | 72 | 816 | 747 | 69 | 46.8 | ○ | ○ |
| Example 20 | 52.9 | 2.3 | 10.9 | 836 | 766 | 70 | 819 | 744 | 75 | 44.0 | ○ | ○ |
| Example 21 | 52.9 | 2.3 | 10.9 | 837 | 765 | 72 | 818 | 742 | 76 | 45.3 | ○ | ○ |
| Example 22 | 46.6 | 2.3 | 9.8 | 839 | 767 | 71 | 821 | 742 | 79 | 46.8 | ○ | ○ |
| Example 23 | 46.8 | 2.4 | 9.8 | 838 | 774 | 64 | 817 | 739 | 78 | 47.2 | ○ | ○ |
| Example 24 | 52.5 | 2.0 | 9.1 | 844 | 767 | 78 | 823 | 744 | 78 | 46.5 | ○ | ○ |
| Example 25 | 54.1 | 1.8 | 9.1 | 836 | 771 | 64 | 820 | 741 | 80 | 46.5 | ○ | ○ |
| Example 26 | 52.0 | 1.9 | 10.3 | 841 | 766 | 75 | 817 | 747 | 71 | 46.3 | ○ | ○ |
| Example 27 | 50.0 | 2.2 | 10.6 | 843 | 766 | 76 | 816 | 742 | 74 | 47.2 | ○ | ○ |
| Example 28 | 50.0 | 2.0 | 10.7 | 843 | 771 | 72 | 817 | 739 | 78 | 47.0 | ○ | ○ |

TABLE 6

| | Characteristics after finish rolling | | | | | | | | | | | |
|---|---|---|---|---|---|---|---|---|---|---|---|---|
| | Crystal grain size | $I[200]/I_0[200]$ | Area ratio of Cube orientation | Tensile Strength (MPa) | | | 0.2% yield strength (MPa) | | | Electrical Conductivity | 180 degree bending workability | |
| | (um) | after finishing | (%) | RD | TD | RD − TD | RD | TD | RD − TD | (% IACS) | Good Way | Bad Way |
| Comparative Example 1 | 77.1 | 3.1 | 13.1 | 826 | 756 | 70 | 801 | 737 | 64 | 46.8 | ○ | ○ |
| Comparative Example 2 | 56.3 | 2.9 | 12.0 | 835 | 761 | 74 | 813 | 730 | 83 | 46.3 | ○ | ○ |
| Comparative Example 3 | 69.2 | 3.0 | 12.9 | 822 | 742 | 80 | 811 | 721 | 90 | 43.2 | ○ | ○ |
| Comparative Example 4 | 27.4 | 2.9 | 11.8 | 844 | 767 | 78 | 807 | 719 | 88 | 49.6 | ○ | ○ |
| Comparative Example 5 | 42.9 | 0.9 | 3.6 | 834 | 771 | 63 | 810 | 736 | 75 | 46.5 | X | X |
| Comparative Example 6 | 90.0 | 5.2 | 21.1 | 830 | 779 | 52 | 808 | 737 | 71 | 46.8 | ○ | ○ |
| Comparative Example 7 | 43.7 | 3.3 | 14.1 | 838 | 768 | 70 | 821 | 736 | 85 | 46.8 | ○ | ○ |
| Comparative Example 8 | 90.0 | 2.8 | 12.0 | 835 | 771 | 63 | 820 | 735 | 85 | 46.3 | ○ | ○ |
| Comparative Example 9 | 33.6 | 3.2 | 13.0 | 851 | 786 | 65 | 823 | 738 | 85 | 47.2 | ○ | ○ |
| Comparative Example 10 | 90.0 | 2.8 | 12.0 | 835 | 771 | 63 | 820 | 735 | 85 | 43.5 | ○ | ○ |
| Comparative Example 11 | 33.6 | 3.2 | 13.0 | 851 | 786 | 65 | 823 | 738 | 85 | 49.6 | ○ | ○ |
| Comparative Example 12 | 76.2 | 2.6 | 11.3 | 839 | 776 | 64 | 821 | 746 | 75 | 46.8 | ○ | ○ |
| Comparative Example 13 | 76.1 | 2.5 | 11.2 | 837 | 767 | 70 | 819 | 742 | 77 | 46.6 | ○ | ○ |
| Comparative Example 14 | 76.3 | 2.4 | 11.4 | 842 | 773 | 68 | 820 | 745 | 75 | 46.7 | ○ | ○ |
| Comparative Example 15 | 76.1 | 2.4 | 11.2 | 843 | 773 | 69 | 820 | 743 | 77 | 46.8 | ○ | ○ |
| Comparative Example 16 | 76.1 | 2.5 | 11.1 | 839 | 772 | 67 | 821 | 745 | 76 | 46.8 | ○ | ○ |
| Comparative Example 17 | 76.5 | 2.6 | 11.0 | 838 | 772 | 66 | 822 | 750 | 72 | 46.9 | ○ | ○ |
| Comparative Example 18 | 76.8 | 2.3 | 11.3 | 837 | 768 | 70 | 820 | 744 | 76 | 46.9 | ○ | ○ |
| Comparative Example 19 | 76.1 | 2.5 | 11.4 | 847 | 776 | 71 | 822 | 747 | 75 | 46.8 | ○ | ○ |
| Comparative Example 20 | 76.1 | 2.5 | 11.4 | 838 | 775 | 63 | 819 | 743 | 76 | 47.0 | ○ | ○ |
| Comparative Example 21 | 76.2 | 2.5 | 11.2 | 837 | 769 | 69 | 819 | 748 | 71 | 46.8 | ○ | ○ |
| Comparative Example 22 | 76.1 | 2.4 | 11.2 | 843 | 771 | 72 | 819 | 740 | 79 | 46.9 | ○ | ○ |
| Comparative Example 23 | 76.4 | 2.5 | 11.4 | 842 | 768 | 74 | 822 | 744 | 78 | 46.9 | ○ | ○ |
| Comparative Example 24 | 76.4 | 2.3 | 11.4 | 842 | 773 | 69 | 822 | 746 | 76 | 46.8 | ○ | ○ |
| Comparative Example 25 | 5.3 | 1.1 | 4.5 | 841 | 769 | 72 | 822 | 738 | 84 | 47.5 | ○ | ○ |
| Comparative Example 26 | 23.0 | 0.1 | 0.2 | 752 | 725 | 27 | 711 | 695 | 16 | 40.0 | ○ | ○ |
| Comparative Example 27 | 11 | 6.2 | 27 | 760 | 740 | 19 | 726 | 709 | 17 | 40.0 | ○ | ○ |

TABLE 7

| | Characteristics after low temperature annealing (other properties are unchanged) | | | | | | | | | |
|---|---|---|---|---|---|---|---|---|---|---|
| | Tensile Strength (MPa) | | | 0.2% yield strength (MPa) | | | Electrical Conductivity | 180 degree bending workability (R/t) | | Improvement of Plating properties and |
| | RD | TD | RD − TD | RD | TD | RD − TD | (% IACS) | Good Way | Bad Way | Hot workability |
| Example 1 | 848 | 824 | 24 | 819 | 798 | 22 | 48.1 | ○ | ○ | — |
| Example 2 | 868 | 860 | 8 | 843 | 830 | 13 | 47.3 | ○ | ○ | — |
| Example 3 | 900 | 890 | 10 | 890 | 865 | 25 | 48.2 | ○ | ○ | — |

TABLE 7-continued

| | Characteristics after low temperature annealing (other properties are unchanged) | | | | | | | | | |
|---|---|---|---|---|---|---|---|---|---|---|
| | Tensile Strength (MPa) | | | 0.2% yield strength (MPa) | | | Electrical Conductivity | 180 degree bending workability (R/t) | | Improvement of Plating properties and |
| | RD | TD | RD − TD | RD | TD | RD − TD | (% IACS) | Good Way | Bad Way | Hot workability |
| Example 4 | 839 | 815 | 24 | 807 | 784 | 24 | 45.4 | ○ | ○ | — |
| Example 5 | 851 | 834 | 17 | 819 | 805 | 14 | 49.6 | ○ | ○ | — |
| Example 6 | 846 | 819 | 26 | 817 | 794 | 23 | 47.7 | ○ | ○ | — |
| Example 7 | 840 | 819 | 21 | 813 | 793 | 20 | 46.9 | ○ | ○ | — |
| Example 8 | 843 | 821 | 22 | 809 | 775 | 34 | 45.8 | ○ | ○ | — |
| Example 9 | 833 | 810 | 22 | 806 | 783 | 23 | 48.5 | ○ | ○ | — |
| Example 10 | 852 | 836 | 15 | 837 | 806 | 31 | 43.7 | ○ | ○ | — |
| Example 11 | 827 | 812 | 16 | 800 | 780 | 20 | 46.9 | ○ | ○ | — |
| Example 12 | 836 | 795 | 41 | 805 | 770 | 35 | 47.3 | ○ | ○ | — |
| Example 13 | 833 | 820 | 13 | 802 | 790 | 12 | 50.8 | ○ | ○ | — |
| Example 14 | 843 | 826 | 17 | 818 | 797 | 21 | 48.2 | ○ | ○ | — |
| Example 15 | 844 | 829 | 16 | 818 | 798 | 20 | 48.1 | ○ | ○ | — |
| Example 16 | 842 | 822 | 20 | 815 | 798 | 17 | 48.1 | ○ | ○ | — |
| Example 17 | 841 | 827 | 14 | 818 | 799 | 19 | 48.0 | ○ | ○ | — |
| Example 18 | 849 | 826 | 23 | 823 | 796 | 27 | 48.1 | ○ | ○ | — |
| Example 19 | 847 | 829 | 17 | 820 | 798 | 22 | 48.1 | ○ | ○ | — |
| Example 20 | 844 | 824 | 20 | 821 | 795 | 26 | 44.5 | ○ | ○ | — |
| Example 21 | 843 | 822 | 21 | 820 | 793 | 27 | 48.2 | ○ | ○ | — |
| Example 22 | 840 | 821 | 19 | 820 | 796 | 24 | 48.1 | ○ | ○ | — |
| Example 23 | 848 | 824 | 24 | 818 | 799 | 19 | 48.1 | ○ | ○ | ○ |
| Example 24 | 848 | 820 | 28 | 821 | 800 | 21 | 48.3 | ○ | ○ | ○ |
| Example 25 | 848 | 822 | 26 | 816 | 798 | 18 | 48.1 | ○ | ○ | ○ |
| Example 26 | 847 | 820 | 27 | 824 | 798 | 26 | 48.3 | ○ | ○ | ○ |
| Example 27 | 847 | 821 | 26 | 816 | 795 | 21 | 48.1 | ○ | ○ | ○ |
| Example 28 | 848 | 821 | 27 | 825 | 798 | 27 | 48.1 | ○ | ○ | ○ |

TABLE 8

| | Characteristics after low temperature annealing (other properties are unchanged) | | | | | | | | | |
|---|---|---|---|---|---|---|---|---|---|---|
| | Tensile Strength (MPa) | | | 0.2% yield strength (MPa) | | | Electrical Conductivity | 180 degree bending workability (R/t) | | Improvement of Plating properties and |
| | RD | TD | RD − TD | RD | TD | RD − TD | (% IACS) | Good Way | Bad Way | Hot workability |
| Comparative Example 1 | 811 | 742 | 69 | 786 | 721 | 65 | 47.6 | ○ | ○ | — |
| Comparative Example 2 | 811 | 743 | 68 | 795 | 721 | 74 | 48.2 | X | X | — |
| Comparative Example 3 | 812 | 740 | 72 | 798 | 711 | 87 | 44.6 | ○ | ○ | — |
| Comparative Example 4 | 814 | 766 | 49 | 781 | 712 | 69 | 49.9 | ○ | ○ | — |
| Comparative Example 5 | 830 | 768 | 62 | 799 | 730 | 69 | 48.1 | X | X | — |
| Comparative Example 6 | 825 | 770 | 55 | 795 | 730 | 65 | 47.4 | ○ | ○ | — |
| Comparative Example 7 | 810 | 746 | 65 | 799 | 721 | 79 | 48.0 | ○ | ○ | — |
| Comparative Example 8 | 820 | 760 | 60 | 797 | 730 | 67 | 48.0 | ○ | ○ | — |
| Comparative Example 9 | 825 | 770 | 55 | 799 | 728 | 71 | 48.4 | ○ | ○ | — |
| Comparative Example 10 | 815 | 761 | 54 | 797 | 730 | 67 | 48.0 | ○ | ○ | — |
| Comparative Example 11 | 820 | 765 | 55 | 799 | 728 | 71 | 48.4 | ○ | ○ | — |
| Comparative Example 12 | 841 | 766 | 75 | 799 | 723 | 76 | 48.1 | ○ | ○ | — |
| Comparative Example 13 | 842 | 765 | 77 | 819 | 729 | 90 | 41.0 | ○ | ○ | X |
| Comparative Example 14 | 843 | 767 | 76 | 785 | 723 | 62 | 48.1 | ○ | ○ | — |
| Comparative Example 15 | 841 | 766 | 75 | 819 | 730 | 89 | 39.8 | ○ | ○ | X |
| Comparative Example 16 | 841 | 764 | 77 | 795 | 730 | 65 | 48.1 | ○ | ○ | — |

TABLE 8-continued

| | Characteristics after low temperature annealing (other properties are unchanged) | | | | | | | | | |
|---|---|---|---|---|---|---|---|---|---|---|
| | Tensile Strength (MPa) | | | 0.2% yield strength (MPa) | | | Electrical Conductivity | 180 degree bending workability (R/t) | | Improvement of Plating properties and |
| | RD | TD | RD − TD | RD | TD | RD − TD | (% IACS) | Good Way | Bad Way | Hot workability |
| Comparative Example 17 | 840 | 765 | 75 | 819 | 730 | 89 | 39.5 | ○ | ○ | X |
| Comparative Example 18 | 839 | 766 | 73 | 819 | 730 | 89 | 41.1 | ○ | ○ | X |
| Comparative Example 19 | 841 | 767 | 74 | 819 | 730 | 89 | 41.5 | ○ | ○ | — |
| Comparative Example 20 | 842 | 763 | 79 | 819 | 730 | 89 | 39.8 | ○ | ○ | — |
| Comparative Example 21 | 839 | 768 | 71 | 819 | 730 | 89 | 40.5 | ○ | ○ | — |
| Comparative Example 22 | 837 | 765 | 72 | 819 | 730 | 89 | 41.1 | ○ | ○ | — |
| Comparative Example 23 | 840 | 769 | 71 | 819 | 730 | 89 | 39.8 | ○ | ○ | — |
| Comparative Example 24 | 839 | 765 | 74 | 819 | 730 | 89 | 38.9 | ○ | ○ | — |
| Comparative Example 25 | No stress relieving annealing | | | | | | | | | |
| Comparative Example 26 | No stress relieving annealing | | | | | | | | | |
| Comparative Example 27 | No stress relieving annealing | | | | | | | | | |

In Examples 1 to 3, the finish rolling working degrees were 30%, 40% and 50%, respectively, and the {200} crystal plane after finish rolling, the electrical conductivity and the low temperature annealing temperature satisfy the predetermined conditions. By conducting the low-temperature annealing step, the 0.2% yield strength in the rolling perpendicular direction (TD) is increased by 50 to 60 MPa compared to the alloy before conducting the low-temperature annealing (after finish rolling) and the strength anisotropy of 40 MPa or less is achieved. On the other hand, in the Comparative Examples 1 and 2, since the finish rolling degree is outside the range of 30 to 50%, the strength in the direction perpendicular to the rolling direction does not increase even if the low-temperature annealing was carried out and conversely, the strength is decreased by about 10 MPa as compared to the alloy with that before performing the low-temperature annealing.

In Examples 4 and 5, since the electrical conductivity after finish rolling is within the range of 43.5 to 49.5% IACS, and the finish rolling degree, the {200} crystal plane after finish rolling, and the low temperature annealing temperature satisfy the predetermined conditions, the 0.2% yield strength in the direction perpendicular to the rolling direction is increased by about 50 MPa by conducting the low-temperature annealing process, and the strength anisotropy of 40 MPa or less is achieved. On the other hand, in Comparative Examples 3 and 4, since the electrical conductivity after finish rolling is outside the range of 43.5 to 49.5% IACS, the strength in the direction perpendicular to the rolling direction does not increase even if the low-temperature annealing was performed and conversely, the strength is decreased by about 10 MPa as compared to the alloy with that before performing the low-temperature annealing.

In Examples 6 to 9, the {200} crystal plane after finish rolling after finish rolling is within the range of $1.0 \leq I\{200\}/I_0\{200\} \leq 5.0$, finish rolling degree, the electrical conductivity after finish rolling and the low-temperature annealing temperature satisfy the predetermined conditions, the strength in the direction perpendicular to the rolling direction is increased by about 50 MPa as compared with that before the low-temperature annealing, and the strength anisotropy of 40 MPa or less is achieved. On the other hand, in Comparative Examples 5 and 6, since the {200} crystal plane is out of the range of $1.0 \leq I\{200\}/I_0\{200\} \leq 5.0$, the strength in the direction perpendicular to the rolling direction does not increase even if the low-temperature annealing was performed, and conversely, the strength is decreased by about 10 MPa as compared to the alloy with that before low-temperature annealing.

In Examples 10 to 13, since the finish rolling degree, the electrical conductivity after the finish rolling, the {200} crystal plane and the low temperature annealing temperature satisfy the predetermined conditions, the strength in the direction perpendicular to the rolling direction is increased by about 50 MPa and achieves strength anisotropy of 40 MPa or less. On the other hand, in Comparative Examples 7 to 11, the low temperature annealing temperature was outside the range of the formula 1, so that the strength in the direction perpendicular to the rolling direction did not increase even if the low temperature annealing was carried out, and conversely, the strength is decreased by 10 MPa as compared with that before the low temperature annealing.

For Examples 14 to 22, the composition amounts of Ni, Co, Si and Cr, which are main elements of the present invention, are appropriate. In Comparative Examples 12 to 18, since the compositions of the main elements are too high or too low, the strength or the electrical conductivity is extremely poor.

With respect to Examples 23 to 28, the addition amounts of Mg, Sn, Zn, Ag, Ti, and Fe, which are elements that can be added in the present invention, are appropriate, and effects of improving plating adhesion and hot workability are obtained. On the other hand, Comparative Examples 19 to 24 are in the case of exceeding 0.5% by mass, and the effect of improving plating adhesion and hot workability is not obtained. Also, the conductivity is extremely poor.

Comparative Example 25 is a production example in which low temperature annealing is not performed. 0.2% yield strength in the rolling parallel direction, the electrical conductivity and the bending workability are good, but the small strength anisotropy of 40 MPa or less as shown in Examples 1 to 28 (namely, a difference between the rolling parallel direction and the rolling perpendicular direction of the 0.2% yield strength is 40 MPa or less) is not achieved.

Comparative Examples 26 and 27 are also production examples in which low temperature annealing is not performed. In these examples, the strength anisotropy and the bending workability are good, but the composition thereof is inadequate and the low-temperature annealing is not performed. Consequently, 0.2% yield strength and the electrical conductivity are significantly lower than the required level in recent years.

What is claimed is:

1. A copper alloy sheet material comprising 0.5 to 2.5 mass % of Ni, 0.5 to 2.5 mass % of Co, 0.30 to 1.2 mass % of Si and 0.0 to 0.5 mass % of Cr, and the balance Cu and unavoidable impurities, wherein an X-ray diffraction intensity ratio is $1.0 \leq I\{200\}/I_0\{200\} \leq 5.0$ when $I\{200\}$ is a result of the X-ray diffraction intensity of {200} crystal plane of sheet surface and $I_0\{200\}$ is a result of the X-ray diffraction intensity of {200} crystal plane of a standard powder of pure copper, and wherein 0.2% yield strength in a rolling parallel direction (RD) is 800 MPa or more and 950 MPa or less, an electrical conductivity of 43.5% IACS or more and 53.0% IACS or less, 180 degree bending workability in a rolling parallel direction (GW) and a rolling perpendicular direction (BW) is R/t=0, and a difference between the rolling parallel direction (RD) and a rolling perpendicular direction (TD) of the 0.2% yield strength is 40 MPa or less.

2. The copper alloy sheet material of claim 1, further comprising one or more elements selected from the group consisting of Mg, Sn, Ti, Fe, Zn, and Ag by 0.5 mass % or less in total.

3. A method of manufacturing a copper alloy sheet material according to claim 1 comprising:

melting and casting step of melting and casting a raw material of copper alloy having a composition of 0.5 to 2.5 mass % of Ni, 0.5 to 2.5 mass % of Co, 0.30 to 1.2 mass % of Si and 0.0 to 0.5 mass % of Cr, and the balance Cu and unavoidable impurities;

hot rolling step of performing hot rolling while lowering the temperature from 950° C. to 400° C. after the melting and casting step;

cold rolling step of performing cold rolling at a working degree of 30% or more after the hot rolling step;

solution treatment step of performing a solution treatment at a heating temperature of 700° C. to 980° C. for 10 seconds to 10 minutes after the cold rolling step;

aging treatment step of performing aging treatment at 400° C. to 600° C. for 5 to 20 hours after the solution treatment step;

finish cold rolling step of performing cold rolling at a working degree of 30% to 50% after the aging treatment step so as to obtain a copper alloy sheet material having an electrical conductivity of 43.5% IACS or more and 49.5% IACS or less and satisfying an X-ray diffraction intensity ratio of {200} crystal plane of $1.0 \leq I\{200\}/I_0\{200\} \leq 5.0$ by the finish cold rolling step; and subjecting the copper alloy sheet to a low temperature annealing step at a temperature of 250° C. to 600° C. for 10 to 1000 seconds, wherein a manufacturing condition is set such that a calculation formula of $K=(a/30)\times\{3.333\times EC^2-291.67EC+6631\}$ is satisfied between the working degree a (%) of the finish cold rolling step, the electrical conductivity EC (% IACS) of the finish cold rolling step and the temperature K (° C.) of the low temperature annealing step.

4. The method of manufacturing a copper alloy sheet material of claim 3, comprising adding up to 0.5 mass % in total of one or more elements selected from the group consisting of Mg, Sn, Ti, Fe, Zn, and Ag to the copper alloy sheet material.

* * * * *